United States Patent [19]

Johnstone et al.

[11] Patent Number: 4,782,762

[45] Date of Patent: Nov. 8, 1988

[54] WELL CAR END GIRDER ARRANGEMENT

[75] Inventors: Bradford Johnstone, Flossmoor, Ill.; Phillip G. Przybylinski, Schererville; Eugene R. Tylisz, Michigan City, both of Ind.

[73] Assignee: Trinity Industries, Inc., Hammond, Ind.

[21] Appl. No.: 47,981

[22] Filed: May 7, 1987

[51] Int. Cl.[4] ..... B61F 1/10

[52] U.S. Cl. ..... 137/355; 105/411; 105/417; 105/420

[58] Field of Search ..... 105/404, 411, 414, 417, 105/418, 420, 355; 410/44, 78

[56] References Cited

U.S. PATENT DOCUMENTS

| | | | |
|---|---|---|---|
| 685,451 | 10/1901 | King | 105/414 |
| 726,049 | 4/1903 | Grant | 105/416 |
| 887,542 | 5/1908 | Summa | 105/419 |
| 2,142,792 | 1/1939 | Lehr | 105/212 |
| 4,079,676 | 4/1978 | Miller | 105/411 |
| 4,091,742 | 5/1978 | Cordani | 105/366 |
| 4,456,413 | 6/1984 | Pavlick | 410/56 |
| 4,484,527 | 11/1984 | O'Hara | 105/420 X |
| 4,524,699 | 6/1985 | Pavlick | 105/4 R |

*Primary Examiner*—Martin P. Schwadron
*Assistant Examiner*—Stephen M. Hepperle
*Attorney, Agent, or Firm*—Myers & Ehrlich, Ltd.

[57] ABSTRACT

A railway car train comprises five car units. Each car unit has two end structures with a depressed well portion supported therebetween. A pair of side structures extend between the end structures and adjacent the well portion. A floor structure extends between lower portions of the side structures to form the bottom of the well portion. The floor structure includes an end beam extending transversely between lower portions of the side structures at the end of the well portion. The end structure includes a stub center sill connected to a shear plate member. A deflection member is secured to the inward end of the shear plate member. The deflection member includes a vertical wall portion and a sloping wall portion for deflecting containers into the well portion as they are loaded. The deflection member is connected with the shear plate member to form a transverse girder. The floor structure is secured to the girder by floor support members connected to the end beam adjacent the side structure and extending diagonally upwardly and inwardly therefrom to connect with the girder adjacent the center sill to beam loads in the lower portions of the side structures up to the girder and the center sill. Reinforcing plates extend between the end beam and the girder for additionally transferring loads therebetween. A flange member is fixedly connected with each reinforcement plate to rigidify it. The girder is reinforced with box structures and gussets to receive impacts and beam loads transversely.

17 Claims, 5 Drawing Sheets

A
B
C
D
E
8
9
10
11
13
15
17
21
25
27
29
31
33
35
37
39
41
53
55
65
67
69
71
72
100
4
5

WELL CAR END GIRDER ARRANGEMENT

BACKGROUND OF THE INVENTION

Related Applications

This application is related to the U.S. patent application having Ser. No. 47,982, filed May, 7, 1987, and entitled "OFFSET SIDE BEARING STRUCTURE FOR WELL CAR" by inventors Donald B. Yates and Eugene R. Tylisz, and the U.S. patent application having Serial No. 47,980, filed May 7, 1987, and entitled "Well Car End Structure Having Frameless Radial Truck" by inventors Ray L. Ferris and Phillip G. Przybylinski.

DESCRIPTION OF THE PRIOR ART

It is known in the prior art to prepare a railway car having a depressed floor section between its ends for increasing the carrying capacity of the car. It is also known to provide a railway car with an articulated connection connecting it with an adjacent car and supporting both cars on a single truck for reducing the weight of the railway car train.

U.S. Pat. No. 4,524,699 shows a well car having a flat floor structure for supporting cargo-carrying trailers. The floor is supported by a wall at the end of the car which wall extends downward from the level of the end structure of the car to attach to the end of the floor structure. The wall also extends from side to side of the railway car. A continuous wall at the end structure of the car is not structurally efficient for transferring loads from the well upwardly to the end structure of the car to be supported on the truck.

SUMMARY OF THE INVENTION

A railway car is provided comprising first and second longitudinally opposite end structures supported on respective truck means. A pair of laterally spaced side structures connect the end structures. A floor structure is supported between the side structures and between the end structures. The first end structure comprises a stub center sill which has an inward terminal end portion. A girder member is fixedly connected with this inward terminal end portion and extends transversely between the side structures. The floor structure includes a cross beam member supported below the girder member and fixedly connected with lower portions of the side structures. First and second floor support members are each connected with the cross beam member adjacent respective lower portions of the side structures. The first and second floor support members extend generally upwardly and inwardly of the car from the cross beam member and are fixedly connected with the girder adjacent the center sill for securing the cross beam member to the end structure and transferring loads in the lower portions of the side structures to the center sill.

DETAILED DESCRIPTION OF THE DISCLOSURE

Figures 1, 2, 3:
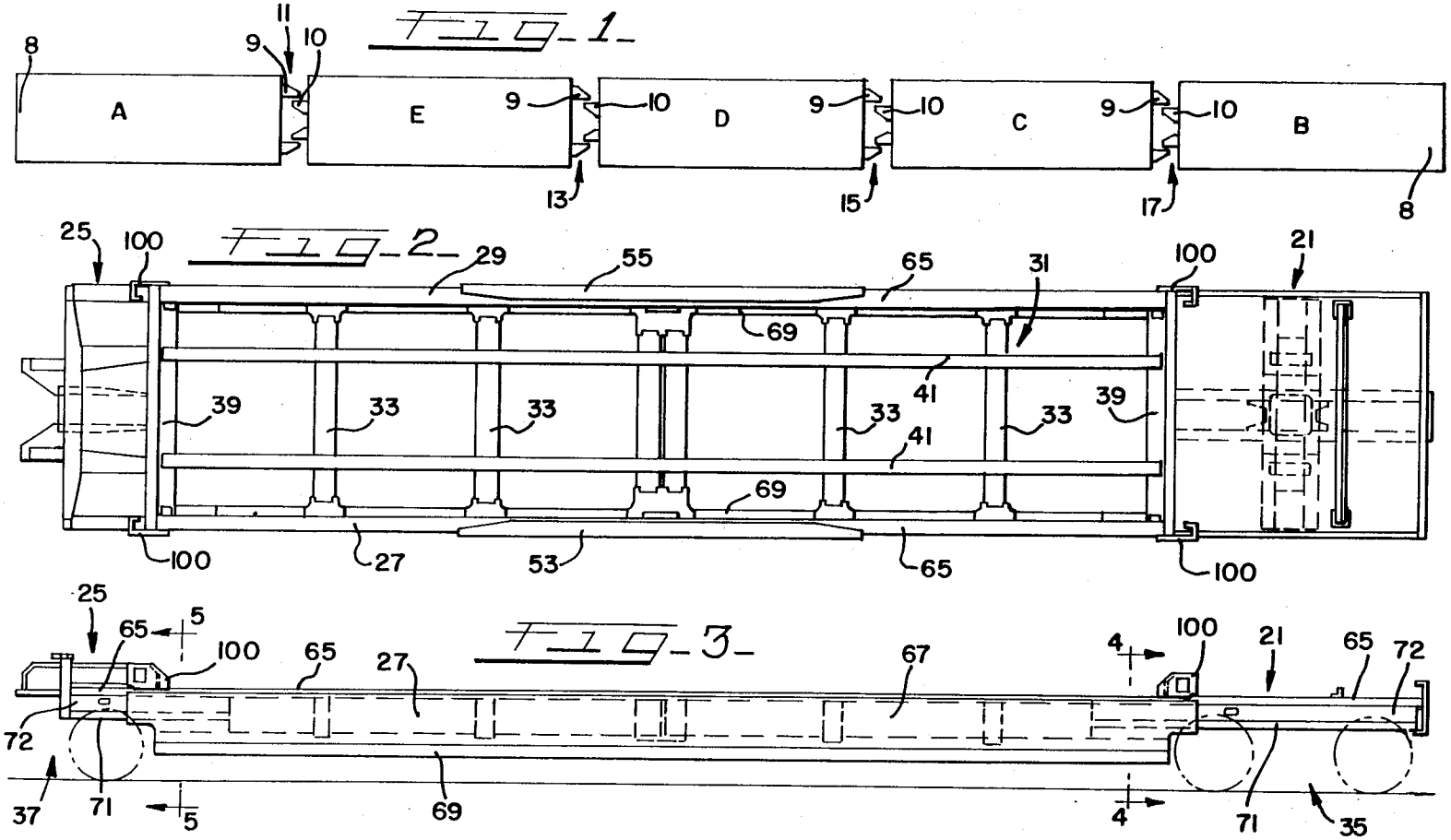
FIG. 1 shows a schematic plan view of a five unit articulated railway car train having the features of this invention.
FIG. 2 is a plan view of the B-unit of the railway car train shown in FIG. 1, showing an articulated end structure and a coupler structure.
FIG. 3 is an elevational view of the railway car in FIG. 2.

An articulated railway car train 7 is shown in schematic FIG. 1. The train consists of five car units A, B, C, D and E. At the longitudinal ends of the car train 7, car unit A and car unit B each have an end 8 configured for standard coupler connection to standard railway cars (not shown).

Car unit A has an end with a female articulated connection structure 9 coacting with a male articulated connection structure 10 at the end of car unit E for an articulated connection generally indicated at 11 of the car units A and E. Car unit E has a female articulated connection structure at the end thereof opposite the male articulated connection structure 10. The female articulated connection structure 9 of car unit E forms an articulated connection with a male articulated connection structure 10 of car unit D, the articulated connection being generally indicated at 13. Car unit D is configured similarly to car unit E, and has a female articulated connection structure 9 which is operatively associated with the male articulated connection structure 10 of car unit C forming an articulated connection generally indicated at 15. Car unit C is configured similarly to car units D and E and has a female articulated connection structure 9 at its opposite end operatively associated with a male articulated connection structure 10 at the end of car unit B which forms an articulated connection generally indicated at 17.

With reference to FIG. 2, car unit B is shown in a plan view showing the coupler connection end structure generally indicated at 21 and the male articulated end structure generally indicated at 25. As best shown in FIGS. 2 and 3, side structures 27 and 29 are fixedly attached to respective sides of each of the end structures 21 and 25, and extend therebetween for transmitting longitudinal buff and draft loads in the car. A floor structure is generally indicated at 31 and comprises transversely extending cross beam members 33 extending between the lower portions of the side structures 27 and 29. The floor structure 31 is approximately at the height of the axles of trucks 35 and 37 which support the end structures 21 and 25 of car unit B. A floor structure 31 includes transversely extending beams 39 at the longitudinal ends thereof adjacent and below the end structures 21 and 25, and also includes longitudinally extending floor beams 41 fixedly connected with the cross beams 33 and the transverse beams 39.

Figure 4:
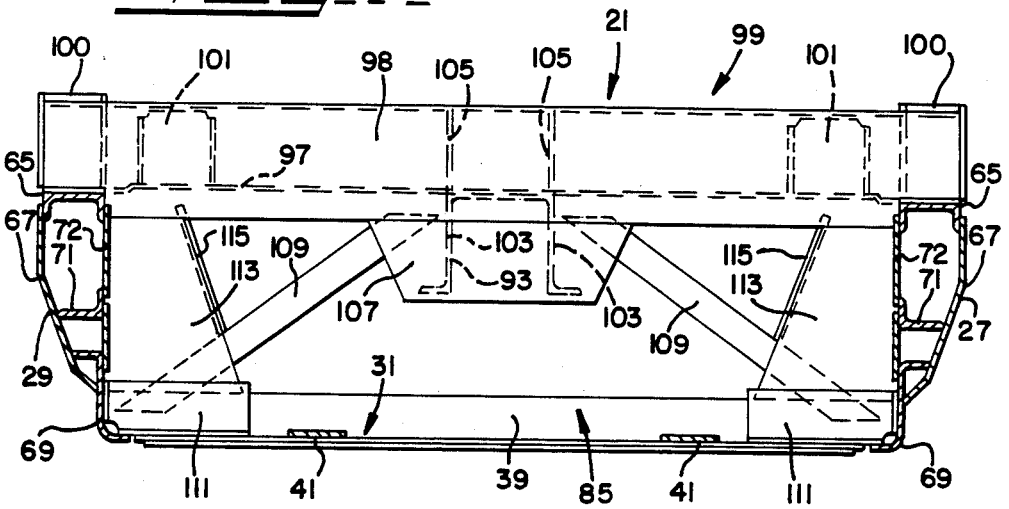
FIG. 4 is a section view taken along line 4—4 of FIG. 3 showing the girder structure supporting the depressed floor of the car adjacent the coupler end of the car.
Figure 5:
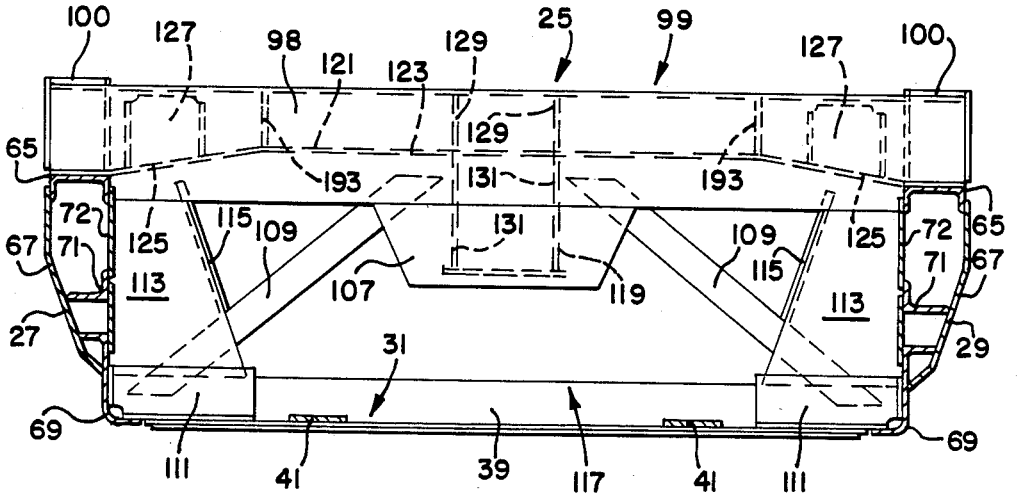
FIG. 5 is a section view taken along line 5—5 of FIG. 3 showing the girder structure supporting the depressed floor of the car adjacent the articulated end of the car.
Figure 9:
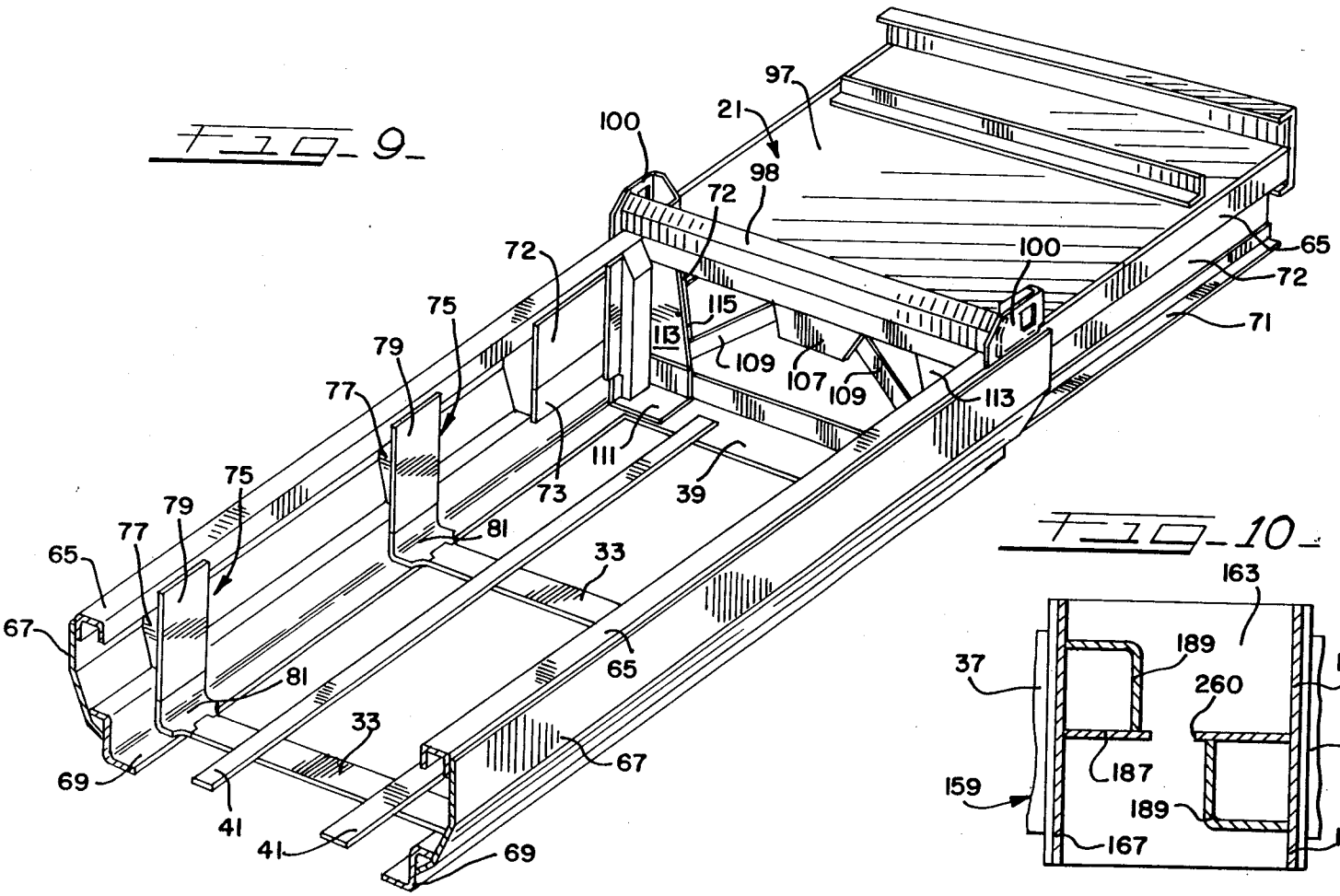
FIG. 9 is a perspective view showing the coupler end structure and a portion of the well structure and side structure of the railway car shown in FIGS. 2 and 3.

As best visible in FIGS. 4, 5 and 9, each of the side structures 27 and 29 includes a channel member 65 which extends substantially the entire length of the car unit.

Adjacent the depressed floor structure 31, each of the side structures 27 and 29 includes an outward cover plate 67 fixedly connected with the channel member 65 and extending downwardly therefrom. The lower end of cover plate 67 is fixedly attached with a generally Z-shaped floor connection member 69 connects with and supports the floor structure 31.

Adjacent the end structures 21 and 25, the side structures 27 and 29 include angle members 71 connected to an inward surface of the cover plate 67 below the channel member 65.

Angle members 71 are connected with channel members 65 by reinforcement plates 72 which extend therebetween. For additional support, reinforcement plates connect angle members 71 with Z-shaped members 69.

The side structures 27 and 29 and the floor structure 31 define a depressed well portion of car unit B. The well portion is approximatedly 40 feet long to receive either a single 40-foot long container or two 20-foot long containers. Adjacent the longitudinal ends of the well portion, car unit B is provided with receiving means in the form of shoes 47 which receive a container therebetween and are snug enough to prevent a container from becoming dislodged from the well portion. To secure a pair of 20-foot containers in the well portion, car unit B is provided with additional receiving means in the form of shoes 49 at the middle of the well portion which securingly engage the side of containers in the well portion.

When two 20-foot containers are placed in the well portion, vertical loads are applied at the middle of the car unit. To aid in the support of these loads, reinforcements 55 and 57 are provided to strengthen the beam qualities of side structures 27 and 29. Also, double cross beam 58 is provided in the floor structure 31 to support the ends of the 20-foot container.

As best shown in FIG. 9, the side structures 27 and 29 are reinforced by beam structures generally indicated at 75 each of which includes a vertically extending plate 77 and a web 79 connected to the lateral outward surface of the plate 77 and laterally inward surface of the cover plate 67, the channel member 65 and the top of the Z-shaped member 69. The beam structure 75 connects at its lower end with cross beam connection member 81 which is connected to the cross beams 33.

A well end structure generally indicated at 85 extends generally vertically and transversely between the side structures 7 and 29 and above the floor structure 31 a each longitudinal end of the well portion.

The coupler connecting end structure 21 includes a center sill 93 as shown in FIGS. 2 and 4. The center sill 93 extends longitudinally of the car and has an inward terminal end 95 adjacent the longitudinally inward end of the end structure 21 and adjacent the well portion. A shear plate member 97 is attached to the upper surface of the center sill 93 and is connected to the channel members 65 of the side structures 27 and 29. Draft and buff loads applied to the center sill 93 are transferred laterally outboard to the side sill structures 27 and 29, and through the side structures 27 and 29 to the opposing end structure 25.

The shear plate member 97 and the inward terminal end 95 of the center sill 93 engage a transversely extending deflection member 98 supported at the end of the well portion of the car. The deflection member 98 includes a vertical portion 98*a* fixedly connected to shear plate member 97 and center sill end 95, and a slope portion 98*a* for guiding containers into the well. The shear plate member 97 forms with the deflection member 98 a girder generally indicated at 99 extending across the railway car 7 and supported above the side structures 27 and 29. The girder 99 is reinforced by lifting lugs 100 and laterally spaced channel shaped gussets 101 attached to the deflection member 98 and the shear plate member 97.

The center sill 93 includes a pair of laterally spaced generally vertically extending walls 103, and the girder 99 is additionally reinforced by a pair of gussets 105 each extending substantially vertically and attached to the shear plate member 97 and tee deflection member 98 substantially vertically aligned with the walls 103 of the center sill. The inward terminal end 95 of the center sill is covered by a trapezoidal cover plate 107 connected with the lower edge of the deflection member 98 and extending downwardly therefrom.

The vertical loads in the well portion of the car 7 are created primarily by the weight of the containers resting on the floor structure 31. These loads are transferred to the Z-shaped members 69 to be borne the side structures 27 and 29 which act as deep beams supporting the loads between the end structures 21 and 25. The loads in the Z-shaped member 69 are also transferred up into the girder 99. The vertical loads are transferred downwardly from the girder 99 to the center sill 93 which rests on a conventional truck 35 supporting the weight of the body of the car 7. The laterally inward transfer of the loads from the Z-shaped member 69 to the center sill 93 is facilitated by channel-shaped floor support members 109 which extend diagonally from a location adjacent the lateral ends of transverse beam 39 and adjacent the Z-shaped members 69 to connect to the lower portion of the deflection member 98 and to the cover plate 107. Floor support members 109 act to transmit loads in the Z-shaped member 69 in a direct path to the center sill 93. To strengthen the lower lateral corners of the well portion for transfer of loads from the Z-shaped member 69 to the channel member 109, the lower corners are provided with an additional corner reinforcement member 111 which is fixedly connected to the Z-shaped member 69 and to the transverse beam 39.

Reinforcing plate members 113 are fixedly connected to the lower portion of the girder 99 and to the upper edge of the transverse beam 39 adjacent each side structure 27 and 29. Plate members 113 flare outwardly to be wider at the bottom thereof for full support of the floor structure 31 adjacent the end structure 21. Stiffening flange members 115 are mounted on the laterally inward edges of the plate members 113 to additionally reinforce the plate member 113 in around the inner edge thereof, which edge tends to bear the greatest load in the plate member 113 in supporting various loads applied in the floor structure 31. Channel member 109 is welded to the longitudinally outward surface of the vertical wall portion of transverse beam 39 and also to the longitudinally outward surface of plate member 113

Referring to FIG. 5, the end structure 25 at the articulated end of the B-unit car is exemplary of the end structure of the articulated ends of car units A, C, D and E. The well end structure generally indicated at 117 is similar to the well end structure 85 adjacent the coupler end structure 21 which was discussed above and the same reference numbers are used for similar elements.

The articulated connection end structure 25 shown in FIG. 5 includes a box center sill 119 and having an inward terminal end engaging a cover plate 107 as in end structure 85. The box center sill 117 has its upper surface fixedly connected with an offset shear plate 121. The offset shear plate member 121 has an elevated center portion 123 connected to the upper surface of the box center sill 119. At the lateral sides of the elevated center portion 123 are slope portions 125 which extend downwardly and outwardly to be fixedly engaged with the channel member 65 of the side structures 27 and 29. The use of the offset shear plate member 121 allows for the side sill members being at a low enough height to provide clearance for container off-loading equipment to gain access to containers in the well portion of the car unit, while permitting the use of relatively larger wheels in the articulated truck 37. The wheels of articulated truck 37 in the embodiment shown are approximately 37" in diameter and are located below the elevated center portion 123 of the offset shear plate member 121. As with shear plate member 97 at the coupler end structure 21, the longitudinally inward end of shear plate member 121 is fixedly connected to the deflection member 98 adjacent end structure 25 and forms a transversely extending girder generally indicated at 99 therewith. Channel-shaped gussets 127 engage the slope portions 125 of the offset shear plate member 121 and also engage the deflection member 98, and have an upwardly, inwardly sloping lower edge for attachment to the shear plate member 121. Gussets 129 are connected to the shear plate member 121 and deflection member 98 substantially vertically aligned with the vertical walls 131 of the box center sill 119. Gussets 129 are somewhat shorter than gussets 105 associated with end structure 21 due to the higher elevation of the center portion 123 of the offset shear plate member 121.

Figure 6:
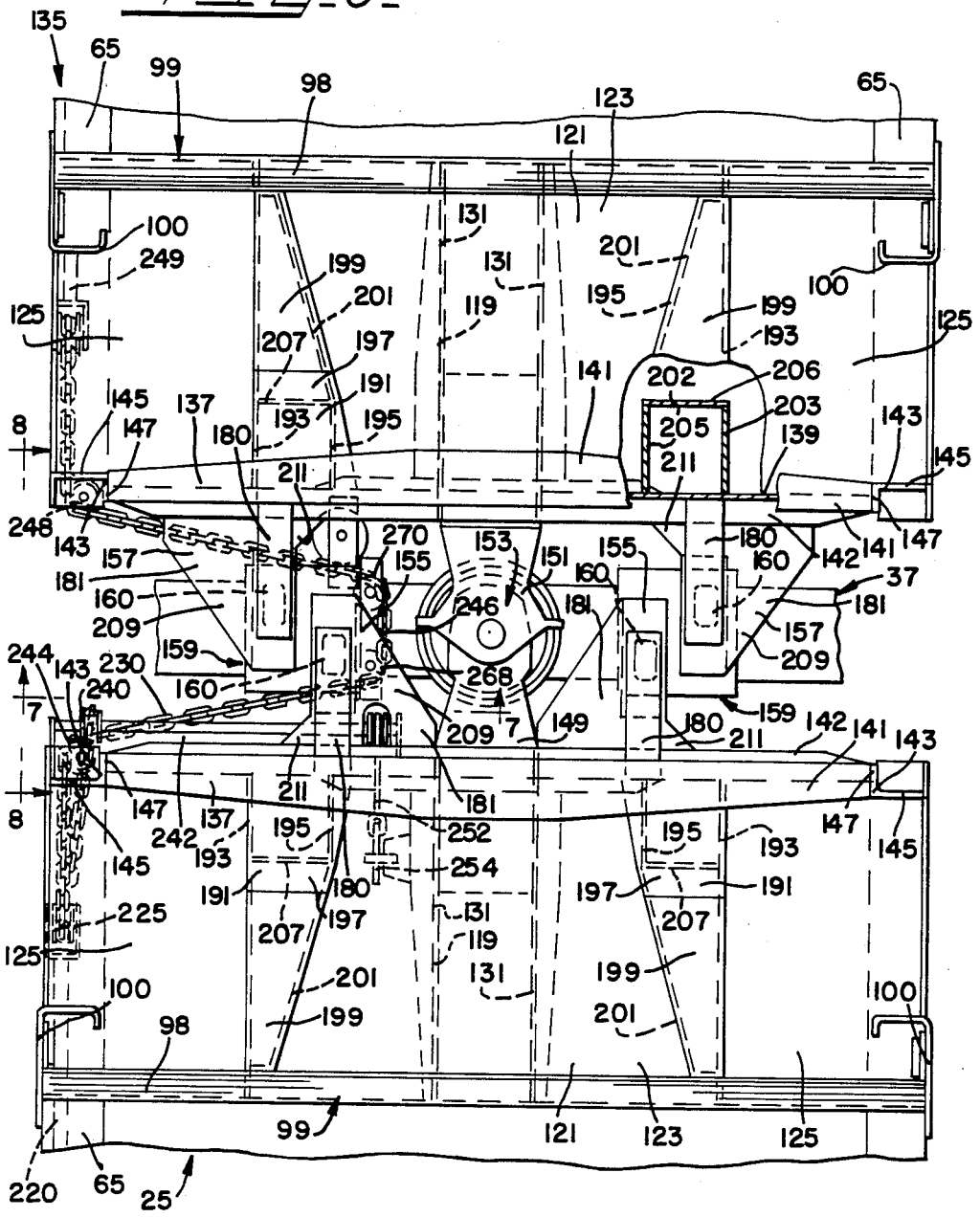
FIG. 6 is a detailed plan view of the articulated connection joining two of the railway cars shown in FIG. 1.

As best shown in FIG. 6, the male articulated connection end structure 25 of the B car unit has an articulated connection with the female end structure 135 of the C car unit, supported on truck 37. The articulated connection shown in FIG. 6 between the end structures 25 and 135 of the B and C car units is typical of the articulated connections between the C and D car units, the D and E car units, and the A and E car units. End structures 25 for pivoted movement of each of the railway car units with respect to the truck 37 about said pivot 153.

To prevent tilting of the car units with respect to the truck 37, the car units are provided with side bearing arms 155 and 157 which engage side bearing structures generally indicated at 159. The side bearing structures 159 are supported on the truck 37 and each include a pair of side bearing elements 160. The female end structure 135 has a pair of laterally spaced side bearing arms 157 thereon The female side bearing arms 157 define a lateral space therebetween, each of the side bearing arms 157 being to a respective side of the truck pivot structure 153. The male end structure 25 has two laterally spaced side bearing arms 155 which extend into the space between the female side bearing arms 157 to permit a close interengagement of the end structures 25 and 135 without contact between the side bearing arms 155 and 157.

As the articulated train passes over curved portions of track, the car units pivot relative to the truck 37. This results in movement of the side bearing arms 155 and 157 relative to truck 37 and side bearing structures 159. Each of the side bearing arms 155 and 157 engages a respective side bearing element 160, and is operatively associated with that side bearing element 160 throughout the range of pivotal movement of the car units with respect to the truck 37.

To provide for sliding engagement between side bearing elements 160 and side bearing arms 155 and 157, a wear plate 177 is fixedly attached to the bottom of each of the side bearing arms 155 and 157 and engages the associated side bearing element 160. The wear plate 177 extends longitudinally somewhat beyond the end of the respective side bearing arms 155 or 157 to maintain engagement with the side bearing element 160 throughout the range of movement of the end structure 135 with respect to the truck 37.

Each of the side bearing arms 155 and 157 has a vertical wall 179 which is fixedly attached to the vertical wall 139 of the end sill structure 137 and extends longitudinally therefrom. A top flange 180 extends from the vertical wall 139 of the end sill structure 137 along the top of the vertical wall 179. Top flange 180 curves slopingly downward adjacent the longitudinal end of the vertical wall 179, and then extends vertically downward to the lower end of the vertical wall 179 to connect to bottom flange 181.

Side bearing arm bottom flange 181 is fixedly attached to the bottom flange 142 of the of the end sill structure 137 and extends outwardly therefrom. Bottom flange 181 has openings therein which receive fastening means in the form of bolts 183 which secure the wear plate 177 to the bottom flange 181.

As best shown in FIG. 6, bottom flange 181 is widest at its point of connection to the end sill structure and tapers outwardly therefrom and to end longitudinally outwardly of the end of the associated side bearing arms 155 and 157. This design provides for support of any lateral loads which may develop in the side bearing arms 155 and 157. Additional support of the connection of bottom flange 181 to the respective side bearing arm 155 or 157 is provided by gussets 185 connected to the bottom flange 181 and the arm vertical wall 179, and by gussets 186 connected to the end sill wall 139 and flange 181.

Figure 7:
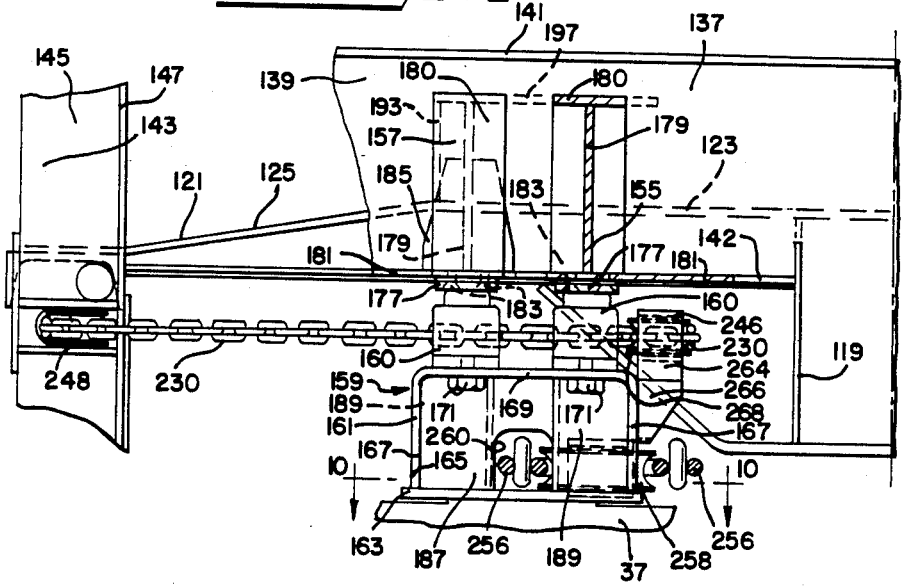
FIG. 7 is a section view taken along line 7—7 of FIG. 6.
Figure 8:
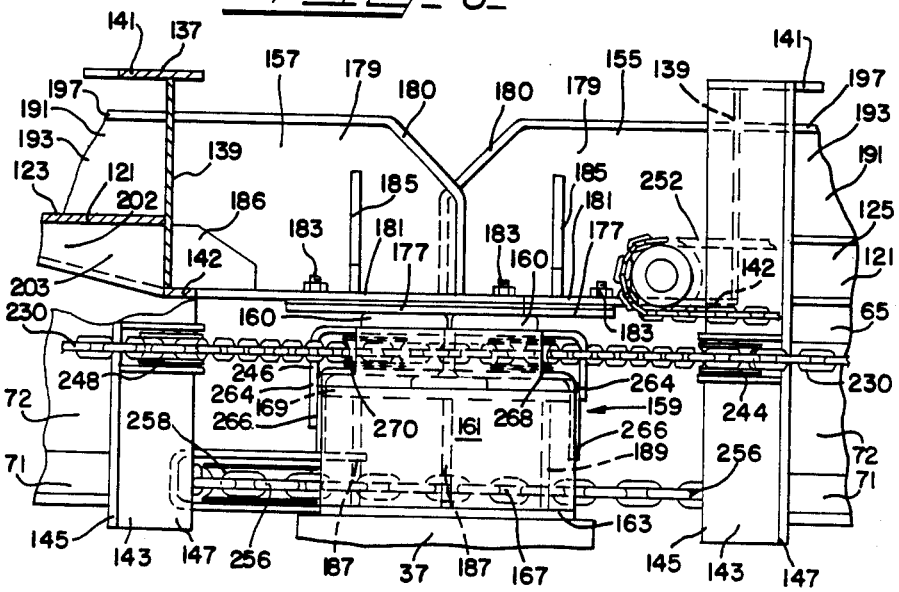
FIG. 8 is a view taken along along line 8—8 of FIG. 6.
Figure 10:
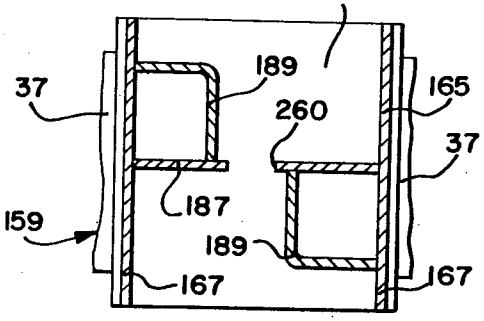
FIG. 10 is a section view taken along line 10—10 of FIG. 7.

As is best visible in FIGS. 7, 8, and 10, the side bearing structures 159 include a support member 161 fixedly attached to the top of the truck 37. The support member 161 includes a bottom plate 163 mounted on the upper surface of the truck 37 and a channel member 165 having a pair of laterally spaced longitudinally extending vertical walls 167 fixedly attached to the bottom plate 163 supporting a generally horizontally extending top plate 169. The top plate has openings therein receiving fastening means in the form of bolts 171 which securingly engage side bearing elements 160.

To aid in the support of side bearing elements 160, a vertical wall 187 extends generally vertically and laterally between the vertical walls 167 of channel member 165 and vertically between bottom plate 163 and top wall 169. A pair of angle-shaped members 189 are supported inside the channel member 165. One of the angle members 189 is connected to one of the walls 167 and to the vertical wall 187 to form therewith a generally vertically extending tubular beam structure extending between the bottom plate 163 and the top wall 169 of the channel member 165 below one of the side bearing elements 160. The other of the angle-shaped members 189 is connected to the other of the vertical walls 167 of the channel member 165 and to the opposite side of the vertical wall 187 to form therewith a second generally vertically extending tubular beam structure providing for reinforcement of the support structure 159 to support the other side bearing element 160.

As best shown in FIGS. 6, 7, and 8, end sill structures 137 of the end structures 25 and 135 are additionally supported by side bearing arm reinforcement structures generally indicated at 191 to bear loads from the side bearing arms 155 and 157. The side bearing arm reinforcement structures 191 include a pair of laterally spaced vertically extending walls 193 and 195 fixedly connected to the longitudinally inward surface of the end wall structures 137. The laterally inward reinforcing walls 195 are spaced approximately 21" laterally of the longitudinal center line of the car, and the laterally outward reinforcing walls 193 are spaced approximately 31¾" from the longitudinal center line of the car. This arrangement of walls 191 and 193 allows for the use of the same end structure construction for use with either a male or female side bearing arm arrangement. When a male arrangement is desired, side bearing arms 155 are secured to the outer surface of vertical wall 139 of end sill structure 137 in locations substantially longitudinally aligned with the laterally inward walls 195. When a female arrangement of side bearing arms is desired, side bearing arms 157 are fixedly attached to the outer surface of vertical wall 139 of end sill structure 137 in locations substantially longitudinally aligned with laterally outward walls 193. In the preferred embodiment, the vertical walls 179 of the male side bearing arms 155 are longitudinally aligned with the vertical reinforcing walls 195. In the female side bearing arms reinforcing walls 193 line up with a portion of side bearing arm top flange 180, which is adequate longitudinal alignment for support of the arms 157.

As is best visible in FIGS. 6, 7 and 8, the side bearing arm support structures 191 each have a first top plate 197 extending longitudinally inward from the vertical end wall 139 and a second top plate 199 connected to the top portion of the walls 193 and 195 inward of the first top plate 197. Top plates 197 and 199 tie in with wall 139 to support loads received from arm top flange 180.

Reinforcing wall 193 extends longitudinally inward from the end wall 139 and terminates engaging deflection member 98. Reinforcing wall 195 extends longitudinally inward from the vertical end wall 139 and then includes a tapering portion 201 extending longitudinally inward and laterally outward of the car. Portion 201 curves at its inward terminal end and engages wall 193 whereby longitudinal loads in walls 193 and 195 both are beamed inward to this point of connection, and into the deflection member 98.

The side bearing arm reinforcement support structure 191 also includes a channel-shaped member 202 connected below the shear plate member 121. Channel member 202 includes a pair of laterally spaced vertical walls 203 and 205 which are vertically aligned with walls 193 and 195 respectively. The longitudinally inward end of the channel member 202 engages lug 206 secured to the undersurface of the shear plate member 121. A vertical wall 207 extends transversely above shear plate member 121 and between reinforcement walls 193 and 195 above the point of contact of the channel member on the lower surface of the shear plate for supporting loads applied by the channel member 202.

Wall 193 is supported on the upper surface of the shear plate 121 and extends along the line of the angled bend formed by the center portion 123 and slope portion 125 of the shear plate member 121 to act as a stiffening member for reinforcing the shear plate member to transfer loads from the box center sill 119 laterally to the side structures 27 and 29.

The load transfer between the truck 37 and the end structures 25 and 135 consists of loads applied through the articulated connectors 149 and 151 and loads applied at the side bearing arms 155 and 157 by the side bearing elements 173 and 175. Loads through the connectors 149 and 151 are transferred into the center sill 119 of each of the end structures 25 and 135. These loads, which are primarily longitudinal buff and draft loads, are transferred laterally through the offset shear plate member 121 to the channel members 65 at the upper portion of each of the side structures 27 and 29. The lateral transfer of loads through shear plate 121 is also associated with a downward transfer of load from the elevated center portion to the relatively lower channel members 65. This transfer of load in the shear plate 121 requires a stiffening reinforcement to prevent buckling of the shear plate member 121 in the transfer of these loads. This stiffening reinforcement is provided by reinforcing wall 193 which extends the longitudinal length of the shear plate member 121 substantially immediately above the crease in the shear plate member 121 where slope portion 125 meets center portion 123, which would otherwise be the weakest part of the shear plate member 121.

Loads are also transferred from the side bearing arms 155 and 157 into the end structures 25 and 135. The side bearing elements 173 and 175 apply loads on wear plates 177. These loads consist of basically friction loads applied longitudinally and laterally in a horizontal plane on wear plate 177 and a vertical load applied directly upward into wear plate 177 for preventing tilt of the respective end structure 25 and 135 relative to the truck 37. Lateral horizontal loads created by friction of the side bearing elements 173 and 175 are supported essentially by bottom flanges 181 of the side bearing arms 155 and 157. Bottom flanges 181 act as gussets between the side bearing arms 155 and 157 and the end sill structure 137 to prevent lateral bending of the arms. The lateral bending of the arms is prevented in either direction by corner portion 209 of bottom flanges 181 which extends generally the length of the side bearing arm 155 or 157 or the smaller triangular gusset portion 211 which extends between the side bearing arm 155 and 157 and the vertical wall 139 of the end sill structure 137.

The upward loads created by the side bearing arms 155 and 157 resting on the side bearing elements 173 and 175 are applied to wear plate 177 at a distance spaced longitudinally from the connection of the side bearing arms 155 and 157 from the end sill structure 137. This produces upward bending moments in the side bearing arms 155 and 157 which are transferred into the side bearing arms support structure 191. Generally, these loads result in a compression load being applied along the top flange of the side bearing arms 155 and 157. This compression load is transferred through the vertical wall 139 of the end sill structure 137 and to the first top plate 197 of the side bearing arm support structure 191 associated with the side bearing arm 155 and 157. The upward moment bending also produces a tendency towards tension in the lower part of the beam and in the bottom flanges 181. This tension is transferred through the channel member 202 into the side bearing arms support structure 191. From the side bearing arm support structures 191 these loads are transferred into the offset shear plate member 121 and into the side structures 27 and 29 and into the center sill 119. The vertical wall 179 of the side bearing arms 155 and 157 experiences compression loads in its upper portion and tension loads in its lower portion. These loads are transmitted from the vertical wall 179 through the vertical wall 139 of the end sill structure 137 and into reinforcement walls of 193 and 195 and the walls of the channel member 202.

The bending moments at end sill structure 137 arising from loads applied to side bearing arms 155 and 157 at wear plates 177 are dependent on the distance from the connection of side bearing arms 155 and 157 to the side bearings 160. This distance is reduced by the elevation of side bearings 160 on support member 161.

The shear plate member 121 is provided with slope portions 125 to accommodate wheels on the truck 37 which have clearance requirements which extend vertically higher than the channel portions 65 of the side structures 27 and 29. The clearance is provided by the elevated center portion 123, and as a result, the lateral location of the crease between the slope portion 125 and center portion 123 is laterally outboard of the wheels of the truck 37. The lateral location of the wheels of the truck 37 require clearance extending outward of the location of the female side bearing element 160.

As described above, reinforcing wall 193 serves the dual purpose of supporting the female side bearing arm 157 and of stiffening the offset shear plate member 121 at the junction of the slope portion 125 and the center portion 123. The lateral location of wall 193 is dependent on the location of the junction of slope portion 125 and center portion 123 which is in turn dependent on the lateral clearance of the wheels. As a result, it is not possible to longitudinally align the vertical wall 179 of the female side bearing arms 157 with the reinforcing wall 193. However, reinforcing wall 193 engages the longitudinally inner surface of wall 139 at a lateral location adjacent that of the vertical wall 179 of the side bearing arm 157 and aligned with a portion of arm top flange 180, which is sufficient longitudinal alignment for load transfer from the arm 157 to wall 193.

American Association of Railroads regulations require that one-half of the trucks in a railway car train be provided with a manually activated hand brake for stopping the cars. In the case of the articulated railway car train 7, six trucks support the five car units A, B, C, D and E. A manually operated brake system is provided which applies braking action to the wheels of truck 35 and supporting the coupler end structure 21 of the B ca unit and to the wheels of the articulated trucks between the B and C car units and between the C and D car units.

The handbrake system is provided with an operator station (not shown) on the coupler and structure 21 of the B car unit. The operator station includes a handle which is rotated by a human operator when braking is desired. Rotation of the handle takes up a length of a first chain which applies force to the wheels of truck 35, and also pulls a connection rod 220 which extends the longitudinal length of the car below channel member 65 of side structure 29.

As best shown in FIG. 6, adjacent articulated end structure 25, the connecting rod 220 is connected to a sheave wheel connection 225. Chain 220 extends around sheave wheel connection 225. One portion of chain 230 is connected to wheel 240 on the lateral end of shaft 242. The other portion of chain 230 extends around sheave wheel 244, laterally inwardly of the car, around guide structure 246 supported on support structure 161, and then around sheave wheel 248 on end structure 135 to connect with a second connecting rod 249 on the C-unit.

When the brake system is activated, connecting rod 220 is drawn away from end structure 25, sheave wheel connection 236, and this tightens both the portion of chain 230 connected with wheel 240 and the portion of chain 230 extending between the B and C units. As the portion of chain 230 connected with wheel 240 tightens, it causes wheel 240 to rotate shaft 242 and with it, wheel 250. Rotation of wheel 250 takes up a length of second chain designated schematically at 252 and connected to an upper end of lever 254 pivotally supported on end structure 25. This causes lever 254 to pivot and to pull a chain 256 connected with the lower end of lever 254. Chain 256 extends above the truck body and around sheave wheel 258 supported on support structure 161. Chain 256 reverses direction around sheave wheel 258 and extends toward end structure 25 through opening 260 in wall 187 of reinforcement structure 161 to engage a truck braking mechanism (not shown) on truck 37. When chain 256 is pulled by lever 254, chain 256 activates the truck braking mechanism and applies braking action to the truck 37.

The effect of drawing connecting rod 234 away from end structure 25 also results in the portion of chain 230 running between the cars being pulled. The movement of chain 230 is transmitted around pulley 244, guide structure 246, and pulley 248 to connecting rod 249. Connecting rod 249 extends substantially the length of the C-unit, similarly to connecting rod 220 on the B-unit, to connect with a braking system associated with the articulated truck between the D and C-units. That braking system is similar to the shaft and lever braking system described above associated with truck 37 between the B and C car-units.

Guide structure 246 includes upper and lower generally channel-shaped members 264 and 266 connected with the laterally inward wall 167 of the channel member 165 of the support structure 161. Two longitudinally spaced sheave wheels 268 and 270 are supported in the space between the channel-shaped members 264 and 266.

As best visible in FIG. 6, the chain 230 extends from sheave wheel 244 to sheave wheel 268 at an angle with respect to end structure 25, and from sheave wheel 270 to sheave wheel 248 at an angle to end structure 135.

When the articulated railway car train 7 passes over curved segments of track, car units B and C pivot with respect to the articulated truck 37 and therebetween. This results in relative movement of sheave wheels 244 and 248 toward and away from each other. If chain 230 were to extend directly across between sheave wheels 244 and 248, the variations in distance would at times tighten the chain 230 and apply braking action during cornering of the car.

To reduce the effect of relative pivoting of the B and C units on the tension in chain 230, the chain 230 extends around the sheave wheels 268 and 270 of guide structure 246 which is supported adjacent the truck pivot structure 153.

To minimize effects of relative angular rotation of the cars on the chain 230 during cornering, the optimal path of the chain 230 from the sheave wheels 244 and 248 to sheave wheels 268 and 270 would extend directly toward the pivotal center point of the truck pivot structure 153. In the embodiment shown, chain 230 extends generally along this path, deviating slightly therefrom to provide clearance around the side bearings 160 and and clearance for movement of the articulated connectors 149 and 151. The closer the position of guide structure 246 is to the pivotal center of the articulated connection, the less the effect of the angulation of the cars during cornering on the chain. In the preferred embodiment, the sheave wheels 268 and 270 are approximately 10 inches from the geometrical pivot point of the articulated connection, which results in only sight variations in tension in the chain 230 during cornering of the car.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A railway car comprising:

first and second longitudinally opposite end structures;

a pair of laterally spaced side structures connecting the end structures;

a floor structure supported between the side structures and between the end structures;

a pair of truck means each supporting a respective end structure;

the first end structure comprising;

a center sill having an inward portion;

a girder member fixedly connected with the inward portion of the center sill and extending transversely with respect thereto, said girder member being fixedly connected with the side structures;

the floor structure including a cross beam member supported below the girder member of the end structure;

each of the side structures including a longitudinally extending lower portion fixedly connected with the cross beam member;

first and second floor supported members each being connected with the cross beam member adjacent respective lower portions of the side structures;

said first and second floor support members extending generally upwardly and inwardly of the car from said cross beam member and being fixedly connected with said girder member adjacent said center sill for securing said cross beam member to the end structure sand for beaming loads in the lower portions of the side structures upwardly and inwardly to be supported by the center sill; and said center sill being a stub center sill; and a top plate member fixedly connected with the center sill and with the side structures for beaming longitudinal loads therebetween.

2. The invention according to claim 1 and first and second reinforcement means being connected with the girder member and depending downwardly therefrom adjacent respective side structures;

said first and second reinforcement means being fixedly connected with the cross beam member for transmitting loads therein to the girder member.

3. The invention according to claim 2 and said reinforcing means each comprising a plate member fixedly connected with the cross beam member and the girder member.

4. The invention according to claim 3 and first and second reinforcing flange means each fixedly connected with a respective plate member.

5. The invention according to claim 2 and said reinforcing means each tapering to be wider at the lower end thereof than at the upper end thereof to connect with a respective cross support member for receiving loads therefrom.

6. The invention according to claim 1 and each of said floor support members comprising a channel-shaped member fixedly connected with the girder member for supported lateral loads received from the cross beam member.

7. The invention according to claim 1 and said cross beam member including an upwardly extending flange portion fixedly connected with the floor support members.

8. The invention according to claim 1 and a connection reinforcing plate means connected with the girder member and extending downwardly therefrom, said floor support members being fixedly connected with said connection reinforcing plate means for additionally strengthening the connection of the floor support members to the girder member.

9. The invention according to claim 1 and said girder member including a generally vertically disposed wall portion and an upper flange portion fixedly connected with the wall portion and extending generally outwardly therefrom for reinforcing the wall portion, and the top plate member being fixedly connected with the wall portion to form with the girder member a transversely extending beam for supporting loads from the floor support members and the side structures.

10. The invention according to claim 9 and the upper flange portion sloping upwardly and outwardly from the wall portion to provide a deflection surface for guiding containers being loaded onto the car.

11. The invention according to claim 9 and gusset means fixedly connected with the top plate member, the wall portion, and the flange portion for reinforcing said girder member.

12. The invention according to claim 11 and said gusset means comprising a channel-shaped member connected with the top plate member and the girder member to form a box reinforcement structure therewith.

13. The invention according to claim 9 and a connection reinforcing plate means connected with the girder member and extending downwardly therefrom, said floor support members being fixedly connected with the connection reinforcing plate means for additionally strengthening the connection of the floor support members to the girder member.

14. The invention according to claim 13 and said stub sill having an inward terminal end; said connection reinforcing plate means being connected to the terminal end of the center sill for the transfer of loads thereto.

15. The invention according to claim 9 and said center sill having a pair of laterally spaced, generally vertically extending walls; and the end structure including a pair of gusset members each fixedly connected with the top plate member and the girder member substantially directly above a respective wall of the center sill for the firm reinforcement of a middle portion of the girder member for receiving impacts during loading of the car.

16. A railway car for the transport of cargo comprising;

first and second longitudinally opposite end structures connected by a pair of laterally spaced side structures;

floor structure supported between the side structures and between the end structures;

a pair of truck means each supporting a respective end structure;

one of the end structures comprising:

a stub center sill having an inward terminal end portion;

a girder member connected with and extending between the side structures, said girder member having a center portion fixedly connected with the inward portion of the center sill;

the floor structure including a cross beam member supported below the girder member of the end structure;

each of the side structures having a longitudinally extending lower portion fixedly connected with the cross beam member;

first and second floor support members each being connected with the cross beam member adjacent respective lower portions of the side structures;

said first and second floor support members extending generally diagonally upwardly and inwardly of the car from said cross beam member and being fixedly connected with the center portion of said girder member adjacent said terminal end of said center sill for securing said cross beam member to the end structure and for beaming loads in the lower portions of the side structures upwardly and inwardly to be supported by the center sill;

first and second reinforcement plate members being connected with the girder member and depending downwardly therefrom adjacent respective side structures;

said first and second reinforcement plate members being fixedly connected with the cross beam member for transmitting loads therein to the girder member; and first and second reinforcing flange means each fixedly connected with a respective plate member for the stiffening thereof to resist impacts from containers.

17. The invention according to claim 16 and said reinforcing plate members each tapering to be wider at the lower end thereof than at the upper end thereof to connect with a respective cross support member for receiving loads therefrom.

* * * * *